US006870331B2

(12) United States Patent
Bechis et al.

(10) Patent No.: US 6,870,331 B2
(45) Date of Patent: Mar. 22, 2005

(54) SPACE-SAVING CATHODE RAY TUBE EMPLOYING A NON-SELF-CONVERGING DEFLECTION YOKE

(75) Inventors: Dennis J. Bechis, Yardley, PA (US); David A. New, Mercerville, NJ (US); Joseph M. Carpinelli, Lawrenceville, NJ (US); Charles M. Wine, Princeton, NJ (US); Michael A. Isnardi, Plainsboro, NJ (US)

(73) Assignees: Sarnoff Corporation, Princeton, NJ (US); Orion Electric Company, LTD, Kyung-Bukm (KR)

( * ) Notice: Subject to any disclaimer, the term of this patent is extended or adjusted under 35 U.S.C. 154(b) by 414 days.

(21) Appl. No.: 09/858,818

(22) Filed: May 16, 2001

(65) Prior Publication Data

US 2001/0048271 A1 Dec. 6, 2001

Related U.S. Application Data

(60) Provisional application No. 60/208,171, filed on May 31, 2000.

(51) Int. Cl.[7] ..... H01J 29/80

(52) U.S. Cl. ..... 315/375; 313/440; 348/829

(58) Field of Search ..... 315/375; 313/402, 313/409, 413, 415, 421, 440, 462–463; 348/327, 380, 805–806, 829

(56) References Cited

U.S. PATENT DOCUMENTS

| | | | | |
|---|---|---|---|---|
| 2,721,287 A | | 10/1955 | Van Ormer | 213/409 |
| 3,005,921 A | | 10/1961 | Godfrey | 313/85 |
| 3,185,879 A | | 5/1965 | Evans, Jr. | 313/78 |
| 3,233,144 A | | 2/1966 | Kuroda et al. | 315/382.1 |
| 3,683,224 A | | 8/1972 | Lea | 313/78 |
| 3,983,444 A | | 9/1976 | Odenthal | 313/413 |
| 4,170,785 A | * | 10/1979 | Yoshida et al. | 348/626 |
| 4,183,064 A | * | 1/1980 | Sahara et al. | 348/626 |
| 4,323,816 A | | 4/1982 | Chang | 313/433 |
| 4,329,618 A | | 5/1982 | Chang | 313/431 |
| 4,933,598 A | | 6/1990 | Sudo et al. | 313/477 HC |
| 5,015,925 A | | 5/1991 | Spanjer et al. | 315/382 |
| 5,036,258 A | | 7/1991 | Chen et al. | 315/382 |
| 5,038,074 A | * | 8/1991 | Nakamura | 313/429 |
| 5,187,567 A | * | 2/1993 | Srivastava | 348/627 |
| 5,204,585 A | | 4/1993 | Chen | 315/15 |
| 5,223,920 A | * | 6/1993 | Srivastava | 348/605 |
| 5,327,044 A | | 7/1994 | Chen | 313/433 |
| 5,357,176 A | | 10/1994 | Nishio et al. | 313/376 |
| 5,510,843 A | * | 4/1996 | Keene et al. | 348/446 |
| 5,585,691 A | * | 12/1996 | Washburn | 313/452 |
| 5,644,197 A | | 7/1997 | Leaver | 315/378 |
| 5,748,178 A | * | 5/1998 | Drewry | 345/643 |
| 5,790,913 A | | 8/1998 | Roberts, Jr. et al. | 396/546 |
| 5,872,432 A | | 2/1999 | Beeteson | 315/382.1 |
| 5,949,400 A | * | 9/1999 | Kim | 345/690 |

FOREIGN PATENT DOCUMENTS

| | | | |
|---|---|---|---|
| GB | 903587 | 8/1962 | 267/154 |

OTHER PUBLICATIONS

International Search Report, PCT/US01/16388, Aug. 27, 2001, 3 Pages.

* cited by examiner

*Primary Examiner*—Thuy Vinh Tran
(74) *Attorney, Agent, or Firm*—William J. Burke

(57) ABSTRACT

In a cathode ray tube, plural electron beams are directed towards a faceplate biased at screen potential and are magnetically scanned by a non-self-converging deflection yoke across the faceplate to impinge upon phosphors thereon to produce light depicting an image. The plural electron beams are substantially converged near two opposing edges of the faceplate. A processor changes the raster of the image from a first raster corresponding to position of the image to a second raster corresponding to the position of the plural electron beams on the faceplate. One or more electrodes between the tube neck and the faceplate are biased above and/or below screen potential to deflect electrons landing near the periphery of the faceplate.

29 Claims, 7 Drawing Sheets

SPACE-SAVING CATHODE RAY TUBE EMPLOYING A NON-SELF-CONVERGING DEFLECTION YOKE

This Application claims the benefit of U.S. Provisional Application Ser. No. 60/208,171 filed May 31, 2000.

The present invention relates to a cathode ray tube and, in particular, to a cathode ray tube including a non-converging deflection yoke.

Conventional cathode ray tubes (CRTs), widely utilized in television and computer displays, employ an electron gun positioned in a neck of an evacuated funnel-shaped glass bulb to direct a number of electron beams, usually three, toward the center of a glass faceplate biased at a high positive potential, e.g., 30 kilovolts (kV). A deflection yoke raster scans the electron beams across the faceplate so that phosphors on the faceplate produce light, thereby to produce an image thereon. The deflection yoke includes a plurality of electrical coils positioned on the exterior of the funnel-shaped CRT near its neck. "Horizontal" coils of the deflection yoke produce magnetic fields that cause the electron beams to deflect or scan from side to side and "vertical" coils thereof produce magnetic fields that cause the electron beams to scan from top to bottom. The deflection yoke typically acts on the electron beams only in the first few centimeters of their travel immediately after exiting the electron guns, and the electrons travel in a straight line trajectory thereafter, i.e through a substantially field-free drift region. Conventionally, the horizontal scan produces hundreds of horizontal lines in the time of each vertical scan to produce the raster-scanned image.

The depth of a CRT, i.e. the distance between the faceplate and the rear of the neck, is determined by the maximum angle over which the deflection yoke can bend or deflect the electron beams and the length of the neck extending rearward to contain the electron gun. Greater deflection angles provide reduced CRT depth. Modern magnetically-deflected CRTs typically obtain a ±55° deflection angle (referred to as 110° deflection) and for screen diagonal sizes of about 62 cm (about 25 inches) or more are so deep that they are almost always provided in a cabinet that either requires a special stand or must be placed on a floor. For example, a 110° CRT having an about 100 cm (about 40 inch) diagonal faceplate and a 16:9 aspect ratio, is about 60–65 cm (about 24–26 inches) deep. Increasing the maximum deflection angle so as to reduce the depth of the CRT is disadvantageous and/or impractical due to, e.g., increased power dissipation, greater temperature rise, and the higher cost.

One approach to this depth dilemma has been to seek a thin or so-called "flat-panel" display. Flat panel displays, while thin enough to be hung on a wall, are very expensive and require very different technologies from conventional CRTs which are manufactured in very high volume at reasonable cost. Thus, flat panel displays are not available that offer the benefits of a CRT at a comparable cost.

A CRT that employs a non-converging deflection yoke, i.e. a deflection yoke that does not cause the three electron beams producing the red, green and blue pixel components of a displayed image to land on the CRT faceplate (screen) at the same pixel location at the same time, introduces the problem of obtaining proper convergence. This problem is made more complicated because the mis-convergence is not uniform, i.e. the degree of mis-convergence tends to be greater at the screen edges than near its center. Conventionally, non-converging yokes are converged at screen center and deviations from convergence are corrected by dynamic magnetic convergence of each beam in each of several regions of the screen, which convergence involved performing a tedious, complex and costly convergence adjustment procedure. In addition, the on-screen time of the electron beams during each scan is reduced by any mis-convergence thereby causing a reduction in the corresponding image brightness obtainable.

Conventionally and more recently, a self-converging deflection yoke is employed to avoid the need for alternative convergence means and thus to avoid this problem. However, self-converging deflection yokes undesirably tend to produce much wider spots at the screen edges and corners. Self-converging and other deflection yokes also tend to produce astigmatism that requires the use of high-voltage dynamic modulation of certain grids of the electron gun. Moreover, self-converging deflection yokes are not as advantageous in space saving or other CRTs wherein a high-deflection yoke, e.g., a yoke providing greater than about 120° total deflection, is employed, because the spot distortion they produce is greater and is more difficult to remove.

Accordingly, there is a need for a cathode ray tube having a non-converging deflection yoke and that may allow a CRT depth that is less than that of a conventional CRT having an equivalent screen-size.

To this end, the tube of the present invention comprises a tube envelope having a faceplate and a screen electrode on the faceplate adapted to be biased at a screen potential, a source of a beam of electrons directed toward the faceplate, a non-self converging deflection yoke proximate the source of a beam of electrons, and phosphorescent material disposed on the faceplate for producing light in response to the beam of electrons impinging thereon. A first electrode interior the tube envelope defines an aperture through which the beam of electrons passes, wherein the first electrode is intermediate the deflection yoke and the faceplate and is adapted to be biased at a potential one of greater than and less than the screen.

According to another aspect of the invention, a display comprises a tube envelope having a faceplate and a screen electrode on the faceplate adapted to be biased at a screen potential, a source within the tube envelope of plural beams of electrons directed toward the faceplate, a non-self-converging deflection yoke proximate the source of plural beams of electrons for magnetically deflecting the plural beams of electrons, wherein the non-self converging deflection yoke substantially converges the plural beams of electrons near two opposing edges of said faceplate. Phosphorescent material is disposed on the faceplate for producing light in response to the plural beams of electrons impinging thereon. A processor is coupled to the source of a beam of electrons for providing image information for controlling the plural beams of electrons, the processor changing image information from a first raster corresponding to position of an image to a second raster corresponding to position of the plural beams of electrons on the faceplate when deflected by the non-self-converging deflection yoke

BRIEF DESCRIPTION OF THE DRAWING

The detailed description of the preferred embodiments of the present invention will be more easily and better understood when read in conjunction with the FIGURES of the Drawing which include.

Figure 1:
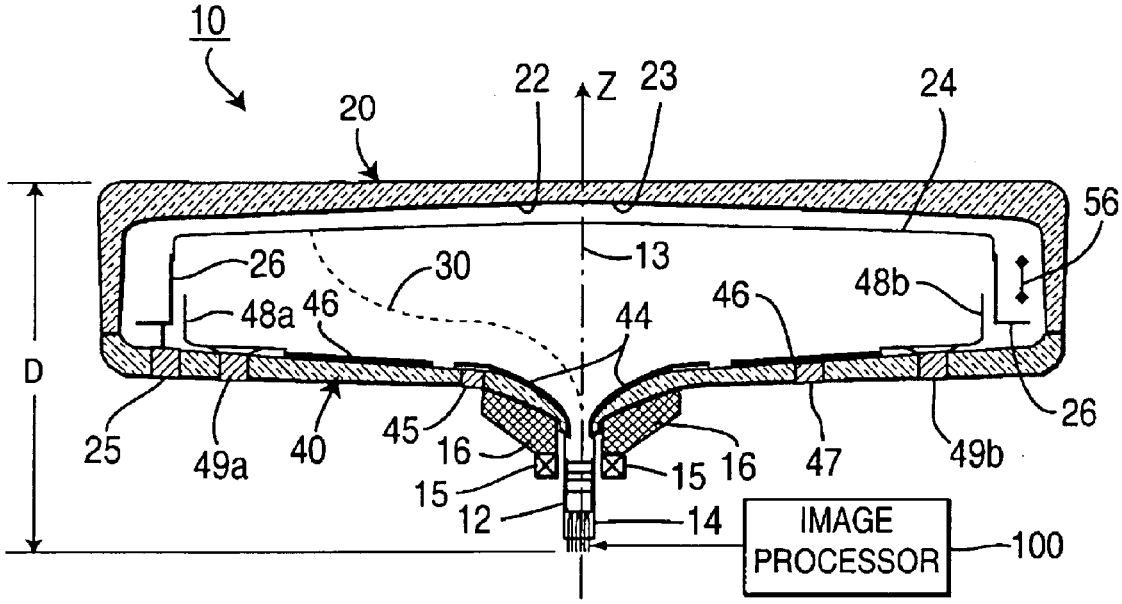
FIG. 1 is a cross-sectional schematic diagram of an exemplary embodiment of a cathode ray tube in accordance with the present invention.

In the Drawing, where an element or feature is shown in more than one drawing figure, the same alphanumeric designation may be used to designate such element or feature in each figure, and where a closely related or modified element is shown in a figure, the same alphanumerical designation primed may be used to designate the modified element or feature. Similarly, similar elements or features may be designated by like alphanumeric designations in different figures of the Drawing and with similar nomenclature in the specification, but in the Drawing are preceded by digits unique to the embodiment described. For example, a particular element may be designated as "xx" in one figure, by "1xx" in another figure, by "2xx" in another figure, and so on. It is noted that, according to common practice, the various features of the drawing are not to scale, and the dimensions of the various features are arbitrarily expanded or reduced for clarity.

DESCRIPTION OF THE PREFERRED EMBODIMENTS

In a cathode ray tube according to the present invention, the deflection yoke is a non-self-converging magnetic deflection yoke and the electrons of the three beams of electrons of the electron beam are arranged so as to be converged at two opposing edges of the screen or faceplate of the tube when deflected under the influence of the magnetic deflection yoke. For example, in a CRT having a horizontal screen dimension that is greater than the vertical screen dimension, the three beams are bent by the action of the electron gun, the deflection yoke and any electrostatic fields in the region between the electron gun and the screen so as to be converged, i.e. land at substantially the same spot or pixel location, at the right hand and left-hand edges of the screen at the same time. Absent further action, a consequence of the foregoing is that the three electron beams are not converged in regions away from the edges of the screen with the greatest mis-convergence being at the center of the screen.

According to the invention, the three beams are converged in regions away from the screen edges either by further elements of the non-self-converging deflection yoke and/or the electron gun, or by realigning and/or otherwise registering the pixel information of the image to be displayed with the actual positions of the non-converged electron beams as they are scanned across the screen.

In an exemplary cathode ray tube according to the present invention, the electrons of the electron beam(s) may be further deflected after leaving the influence of the magnetic deflection yoke, i.e. in what is referred to as the "drift region" of a conventional CRT. In a conventional CRT, the electrons are at the screen or anode potential at the time they leave the electron gun and the deflection region and, not being under the influence of any electric or magnetic field, "drift" to travel in straight lines to the screen or faceplate thereof. In the exemplary CRT, the electrons are subjected to an electric field after leaving the deflection region so as to travel along non-straight trajectories. The electric fields may include an electric field in a first direction that increases the deflection of the electron beams toward the edges of the screen above that provided by the magnetic deflection yoke, or may include an electric field in a second direction that increases the landing angle of the electron beam upon the screen, or may include electric fields in both the first and second directions for both increasing deflection and increasing landing angle. Such inventive cathode ray tube may find application, for example, in television displays, computer displays, projection tubes and other applications where it is desired to provide a visual display.

As used herein convergence of plural electron beams means that the electron beams land on a target at substantially the same "spot" or location at the same time. Typically each "spot" corresponds to a picture element or pixel of an image to be displayed, and physically comprises a plurality of patterns of phosphor on the CRT screen corresponding to the number of beams. Such convergence need not be perfect, but simply be that the landing locations of the plural electron beams are close enough to the same spot or pixel as to provide an acceptable rendition of the image to be displayed at least to some of the potential viewers thereof.

For example, in a color CRT having three beams corresponding to the colors red, green and blue of the image, a color image is produced by an electron beam modulated by red image information landing on a phosphor pattern that produces red light emission, by an electron beam modulated by green image information landing on a phosphor pattern that produces green light emission, and by an electron beam modulated by blue image information landing on a phosphor pattern that produces blue light emission. Convergence in such color CRT generally refers to the so-called red electron beam landing on the red phosphor, the green electron beam landing on the adjacent green phosphor and the blue electron beam landing on the adjacent blue phosphor of the same picture element or pixel. It is noted that a self converging deflection yoke converges the three electron beams of a color CRT on a common spot over substantially the entire area of the CRT screen, whereas a non-self converging deflection yoke (sometimes called a non-converging deflection yoke) does not, so that the three beams are misconverged over at least a portion of the CRT screen.

FIG. 1 is a cross-sectional diagram of an exemplary cathode ray tube 10 according to the present invention. It is noted that unless otherwise specified, such cross-sectional diagrams may be considered to illustrate either the horizontal or the vertical deflection orientation because both appear similar in such diagrams. Three beams of electrons 30 produced by electron gun 12 located in tube neck 14 are directed towards faceplate 20, which includes a screen or anode electrode 22 biased at a relatively high positive potential, and are deflected by magnetic fields produced by non-self-converging deflection yoke 16 to scan across faceplate 20.

Electrodes 44, 46, 48 on tube envelope 40 are biased to predetermined potentials to establish electrostatic fields within tube envelope 40 to deflect electron beams 30 away from the tube 10 centerline further than they are deflected by the magnetic field produced by deflection yoke 16 and/or to increase the landing angle of the electron beams on screen 22. The region in which such electrodes, when biased, produce an electric field affecting the trajectories of electrons of the electron beams may be referred to as the "aperture" thereof, whether or not such electrodes are in a shape to define a physical aperture or hole through which the electron beams pass.

A patterned coating of different phosphorescent materials 23 is disposed on faceplate 20 for producing different colors of light in response to the plural beams of electron beam 30 impinging thereon through apertures in shadow mask 24, thereby providing a color image display. Usually, the three beams of electron beam 30 are referred to as the "red R beam," the "green G beam," and the "blue B beam" indicating the beams that are intended to illuminate the red phosphor, the green phosphor and the blue phosphor, respectively, of patterned phosphor 23.

Electrostatic fields are established within tube 10 by a number of conductive electrodes located on or close to tube funnel or backplate 40 and biased at respective positive potentials, i.e. at potentials of like polarity to that of the screen or anode electrode 22. The bias potentials on electrodes 44, 46, 48 of tube 10 provide an electrostatic field to control the trajectories of the electrons of electron beam 30, thereby to reduce the required distance between the faceplate 20 and electron gun 12 of exemplary tube 10, and to change the landing angle of the electron beam 30 therein.

First electrode 44 surrounds the outlet of gun 12 in the vicinity of neck 14 and is biased at a positive potential that is preferably less than the potential at screen electrode 22. The electrostatic field produced by electrode 44 results in the electrons of the electron beam 30 being slower moving proximate yoke 16, and therefore more easily deflected thereby. The result of the cooperation between electrode 44 and yoke 16 may be utilized to realize either a reduction of yoke power, and therefore a smaller, lighter, less expensive and likely more reliable deflection yoke 16, or a greater deflection angle with the same yoke power and yoke.

Second electrode 46 also surrounds the outlet of gun 12, but is spaced away from neck 14, and is biased at a positive potential that is preferably greater than the potential at screen electrode 22. The electrostatic field produced by second electrode 46 causes the electrons of beam 30 to travel in a parabolic path that bends their trajectories away from faceplate 20, thereby increasing the deflection angle from that produced by magnetic deflection yoke 16 alone, and also decreasing the "landing angle" of electron beam 30 on screen 22. Electrode 46 is desirably positioned so that its electrostatic field does not act on the electrons of electron beam 30 until after they have been substantially fully acted upon by deflection yoke 16.

The "landing angle" is the angle at which electron beam 30 impinges upon screen electrode 22, and in a color CRT, the shadow mask 24 proximate thereto. As a result of the action of deflection yoke 16 and the field of electrode 46, the landing angle becomes smaller as the distance from the central or Z axis of tube 10 becomes greater and/or as the deflection angle of electron beam 30 increases. Because shadow mask 24 has a finite non-zero thickness, if the landing angle is too small, e.g., less than about 25°, too many of the electrons will hit the sides of the apertures in shadow mask 24 instead of passing therethrough, thereby reducing the intensity of the electron beam reaching phosphor 23 on the faceplate 20 and of the light produced thereby.

Electrode 48 is located distal the central or Z axis of tube 10 and near the periphery of faceplate 20 where the landing angle is smallest. Electrode 48 surrounds the outlet of gun 12, but substantially at the periphery of backplate 40, and is biased at a positive potential that is preferably less than the potential at screen electrode 22 to direct electron beams 30 back towards faceplate 20 for increasing the landing angle thereof near the periphery of faceplate 20. Electrode 48 may be biased to a potential less than the potential at neck electrode 44 where desired to provide greater reduction of landing angle. Thus, the electrostatic fields created by electrodes 46 and 48 complement each other in that electrode 46 increases the deflection angle which decreases the landing angle at the periphery of faceplate 20, and electrode 48, which has its strongest effect near the periphery of faceplate 20, acts to increase the landing angle in the region where it might otherwise be undesirably small.

Figure 2:
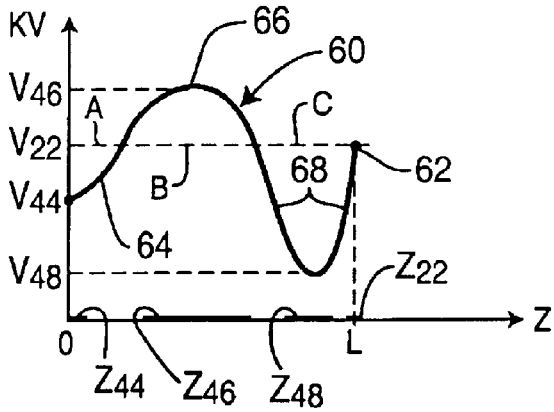
FIG. 2 is a graphical representation of the potential in the cathode ray tube of FIG. 1.

The relationship and effects of the electrostatic fields described above cooperate in a tube 10 that is shorter in depth than a conventional CRT and yet operates at a comparable and/or reasonable deflection yoke power level. An exemplary potential distribution over the depth of tube 10 along its Z axis is illustrated in FIG. 2. Potential characteristic 60 is plotted on a graph having distance from the exit of gun 12 along the ordinate and bias potential in kilovolts along the abscissa. Electrode 22 located at a distance L from gun 12 and represented by region $Z_{22}$ is biased at a relatively high positive potential $V_{22}$ represented at point 62. In order from gun 12 at Z=0 are neck electrode 44 located proximate gun 12 and represented by electrode region $Z_{44}$ that is biased at an intermediate positive potential $V_{44}$, electrode 46 located intermediate gun 12 and faceplate 20 and represented by electrode region $Z_{46}$ that is biased at a relatively high positive potential $V_{46}$ that is preferably higher than the screen potential $V_{22}$, and electrode 48 located more proximate to faceplate 20 and represented by electrode region $Z_{48}$ that is biased at an intermediate positive potential $V_{48}$ that is preferably lower than screen potential $V_{22}$ (but could be equal thereto) and could preferably be lower than gun ultor potential $V_{44}$.

Electrodes 44, 46, 48, 22 and bias potentials $V_{44}$, $V_{46}$, $V_{48}$, $V_{22}$ thereon produce potential characteristic 60 that has a portion 64 in region A rising towards the screen potential $V_{22}$ thereby tending to slow the acceleration of electrons towards faceplate 20 to provide additional flight time during which the subsequent electrostatic fields act upon the electrons. Characteristic 60 has a portion 66 in region B in which the potential peaks at a level relatively higher than the screen potential $V_{22}$ thereby to cause the electrons to move along trajectories that depart further from central axis Z of tube 10 to increase the deflection angle and a portion 68 in region C in which the potential bottoms at a level lower than the screen potential $V_{22}$ and the gun potential $V_{44}$ thereby to cause the electrons to move along trajectories that turn toward faceplate 20 of tube 10 to increase the landing angle of electron beam 30 near the edges thereof.

It is noted that the location of the gap between electrodes 44 and 46 can strongly affect the operation of tube 10. If electrode 46 having a relatively very high positive potential bias extends too close to the exit of gun 12 (and/or neck electrode 44 does not extend sufficiently far therefrom), then the electrons emitted from gun 12 are accelerated and additional magnetic deflection effort is required of deflection yoke 16 (e.g., additional yoke power, field and/or size) to provide the desired magnetic deflection. On the other hand, if neck electrode 44 extends too far beyond the exit of gun 12, then the electrons spend too much time in region A in which electrostatic forces act counter to the deflection sought to be produced by magnetic deflection yoke 16, thereby increasing the power, field and /or size required of yoke 16 to deflect the electron to the corners of faceplate 20, even with the beneficial effect of electrode 46.

The particular values of bias potential are selected in accordance with a particular tube 10 to obtain, for example, a suitable balance of reduced tube depth and reasonable yoke power in consideration of the effects of each of the bias potentials. For example, as the bias potential $V_{44}$ of the ultor of gun 12 is increased, the required 30 deflection power of yoke 16 increases and the depth of tube 10 decreases, indicating that a bias potential of intermediate value is desirable. Thus, a 165° tube with $V_{22}$=30 kV and $V_{44}$=20 kV is about 13.5–15 cm (about 5.4–6 inches) shorter than a conventional 110° CRT. A constant bias potential $V_{46}$ on electrode 46 causes the electrons to follow a substantially parabolic trajectory toward faceplate 20 in region B, however, increasing the bias potential $V_{46}$ reduces the electrostatic forces pulling electrons towards faceplate 20, so that a bias potential $V_{46}$ that is near or greater than the screen potential $V_{22}$ is advantageous to cause the electrons to travel in a more nearly straight line trajectory or to curve away from faceplate 20, thereby to increase the deflection angle and reduce the depth of tube 10. Thus, a bias potential $V_{46}$ of about 30–35 kV is desirable, which, for safety, is below the potential at which X-rays that could penetrate the envelope of tube 10 could be generated. Finally, bias potential $V_{48}$ is preferably a low positive potential to provide an electrostatic force that turns the electrons deflected to the edge regions of faceplate 20 more toward faceplate 20 to increase the landing angle, preferably to above 25°. This field accelerates the electrons towards faceplate 20 subsequent to their being deflected by yoke 16 and the electrostatic field forces produced by bias potential $V_{46}$ and electrode 46.

For example, tube 10 of FIG. 1 may be an about 810-mm (about 32-inch) diagonal 16:9 aspect ratio format cathode ray tube having a viewable area of 660 mm (about 26 inch) width and 371 mm (about 14.6 inches) height. As a result of the reduced tube depth of the present invention, tube 10 has a depth D of about 280 mm (about 11 inches). Non-self-converging deflection yoke 16 may be a 110° or a 125° saddle-saddle type deflection yoke including a saddle-type horizontal coil, a saddle-type vertical coil, a ferrite core and a pair of permeable metal shunts for shaping vertical deflection for self convergence. With the 125° deflection-angle yoke, the diameter of tube neck 14 may be reduced to allow use of a smaller, lower power yoke 16. Preferably, deflection yoke 16 is a non-converging (non-self-converging) deflection yoke providing a total deflection angle of about 135–140° wherein each of the horizontal and vertical deflection coils is of the saddle-type. Specifically, at least the horizontal deflection coil preferably has a non-uniform distribution of turns so that the number of turns effective at the entrance of the yoke (i.e. the end proximate electron gun 12) is substantially greater than the number of turns effective at the exit from the yoke (i.e. the end distal electron gun 12). The distribution of turns typically decreases monotonically between the yoke entrance and exit, but not necessarily linearly, as is determined by the particular arrangement of the shape and electrode arrangement of the cathode ray tube 10, the bias potentials to be applied thereto, and the desired characteristics.

Cathode ray tube 10 employs a combination of electrodes including conductive coatings on tube enclosure 40 and metal electrodes supported within tube envelope 40. Neck electrode 44 is a conductive coating on the wall of tube envelope 40 and is biased at a potential applied via feedthrough 45 penetrating the wall of tube envelope 40. The low bias potential of neck electrode 44, e.g., 10–20 kV and typically about 15 kV, tends to slow the electrons thereby increasing the effectiveness of magnetic deflection yoke 16. Deflection-enhancing electrode 46 surrounds neck electrode 44 and is a conductive coating biased at a potential, e.g., 35 kV, that exceeds the screen potential and is applied via feedthrough 47 penetrating the wall of tube envelope 40. The electric field produced by electrode 46 acts on the electrons of electron beam 30 after the deflection thereof by yoke 16 is substantially completed, thereby to increase deflection of the electron beam 30 beyond that provided by deflection yoke 16.

Third electrode 48 is biased at a potential that is applied via feedthroughs 49 penetrating the wall of tube envelope 40. Electrode 48 is biased at a potential that is less than the screen potential and preferably less than the neck electrode 44 potential, e.g., 0–20 kV and typically about 10 kV, thereby to direct the electrons reaching the peripheral regions of faceplate 20 towards faceplate 20, thereby to decrease their landing angle. Because faceplate 20 is much shorter in the vertical dimension than in the horizontal dimension (which is illustrated in FIG. 1), electrode 48 need not be rectangular as described above so as to act on electrons directed toward the top and bottom edges of the viewable area of faceplate 20, but may be two straight L-shaped formed metal electrodes 48*a*, 48*b* receiving bias potential via feedthroughs 49*a*, 49*b*, respectively, to act only on those electrons directed towards the left and right vertical edges of tube 10. Electrodes 48*a*, 48*b* are supported by feedthroughs 49*a*, 49*b*, respectively, such as by a weld or a conductive glass frit to metal attachment.

Shadow mask 24, supported by shadow mask frame 26, receives screen electrode 22 bias potential, e.g., 30 kV, via feedthrough 25 penetrating the wall of tube envelope 40. Barium getter material 56 is placed at convenient locations, such as behind shadow mask frame 26 and electrodes 48*a*, 48*b*.

A conductive coating or electrode on the inside surface of tube 40, such as on faceplate 20 or glass envelope 40, is preferably a sprayed, sublimated, spin coated or other deposition or application of graphite, carbon or carbon-based materials, aluminum or aluminum oxide, or iron oxide, or other suitable conductive material. Where electrodes, such as electrodes 48*a*, 48*b*, are spaced away from the wall of tube envelope 40, such electrodes are preferably formed of a suitable metal such as a titanium, Invar alloy, steel, stainless steel, or other suitable metal, and are preferably stamped. If magnetic shielding is desired to shield electron beam 30 from unwanted deflection caused by the earth's magnetic field and other unwanted fields, a magnetic shielding metal, such as mu-metal, steel, or a nickel-steel alloy, may be employed.

It is noted that shaping backplate 40 (i.e. the glass funnel of tube 10) to more closely conform to the trajectories of the furthest deflected electron beams 30 improves the effectiveness of the electrostatic forces produced by electrodes 44, 46, 48, thereby to reduce the depth of tube 10. In addition, the gradual potential change over distance illustrated in FIG. 2 allows a larger diameter electron beam 30 at the exit of gun 12, thereby reducing space charge dispersion within electron beam 30 to provide a desirably smaller beam spot size at faceplate 20. The spot size and divergence of electron beam 30 is controlled by the particular electron gun and the convergence of the desired yoke.

Figure 3:
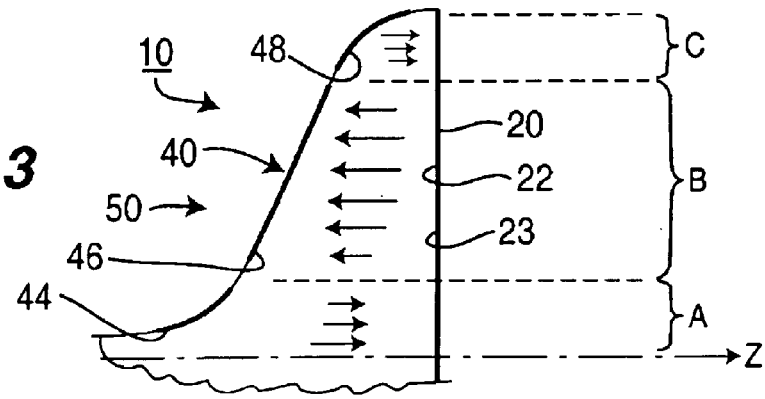
FIG. 3 is a cross-sectional diagram of the tube of FIG. 1 illustrating the electrostatic forces therein.

FIG. 3 illustrates tube 10 (only half of tube 10 being illustrated because of symmetry about the Z axis, i.e. in what could be designated the X plane and the Y plane) as described above having electrodes 22, 44, 46, 48 biased to produce a potential distribution as in FIG. 2. Electron beams 30 are not illustrated, but arrows are shown directed either towards or away from faceplate 20 representing the net electrostatic force acting on the electrons of beam 30 as they pass through the regions A, B and C as described above. In region A, the net electrostatic force directs electrons towards faceplate 20 under the influence of the relatively high positive bias potential $V_{22}$ of screen electrode 22 and the intermediate positive bias potential $V_{44}$ on electrode 44. In region B, the net electrostatic force deflects electrons away from faceplate 20 under the influence of the relatively very high bias potential $V_{46}$ on electrode 46, i.e. greater than screen potential $V_{22}$. In region C, the net electrostatic force again directs the electrons towards faceplate 20 under the influence of the screen potential $V_{22}$ as assisted by the low positive bias potential $V_{48}$ on electrode 48.

It is noted that the effect of the electrostatic force produced by the relatively very high bias potential on electrode 46 (i.e. higher than the bias potential $V_{22}$ of screen electrode 22) is to increase deflection of electron beam 30 beyond that produced by the magnetic deflection of yoke 16. Because electrode 46 acts to amplify the total deflection above that produced by yoke 16, it may be referred to as "yoke amplifier" 50. In particular, the deflection amplification produced by yoke amplifier 50 is directly proportional to the deflection of any particular electron by yoke 16. In other words, electrons moving towards faceplate 20 along or near the Z axis (i.e. those undeflected or little deflected by yoke 16) are not affected by yoke amplifier 50. Those electrons deflected by yoke 16 to land intermediate the Z axis and the edge of faceplate 20 are additionally deflected by yoke amplifier 50 because they pass through a portion of region B in which yoke amplifier 50 acts. Those electrons deflected by yoke 16 to land near the edge of faceplate 20 are additionally deflected an even greater amount by yoke amplifier 50 because they pass through the entirety of region B in which yoke amplifier 50 acts and so are more strongly affected thereby. Yoke amplifier 50 may also be considered to include electrode 44 which, when biased at a potential less than the screen potential, beneficially reduces the effort or power required by deflection yoke 16 to obtain a given deflection of electron beam 30.

Because deflection yoke 16 is a non-self converging deflection yoke arranged for substantially converging the red, green and blue beams at two opposing edges of screen 22, tube 10 includes or operates in conjunction with one or more means 15, 100 for effectively converging the image produced on faceplate 20 as a result of electron beams 30 being scanned thereover. Such means 15, 100 may provide convergence of the image produced either by actually converging the three beams on a common spot as they are scanned over the screen 22 or by altering the image information modulating the three beams to correspond to the actual location of each beam, thereby countering the effect of the mis-convergence. In either case according to the invention, electron gun 12 and deflection yoke 16 substantially converge the three electron beams when they are deflected to land near or at the two opposing edges, e.g., the left-hand and the right-hand edges, of screen 22.

In the first case, the combined action of electron gun 12 and deflection yoke 16 is arranged so that the three electron beams are converged when they are deflected to land at two opposing edges, e.g., the left and right edges, of screen 22, such as by establishing the spacing and/or the angle at which the outer (e.g., red and blue) electron beams are spaced apart from and/or diverge from the center (e.g., green) electron beam as they exit electron gun 12 and enter the region of the magnetic deflection field of yoke 16. Electron gun 12 is arranged to provide the desired beam spacing and/or divergent beam angles, which may include three parallel beams, for convergence at the screen 22 edges. Magnetic and/or electrostatic (M/E) means are provided for correcting mis-convergence away from the screen edges. For example, one or more magnetic pole pieces or electrodynamic convergence plates in electron gun 12 may adjust and/or modulate the electron beam divergence angle at its exit from gun 12 for beam convergence at screen center. Additional coils in yoke 16 may also be provided to adjust the divergence angle for converging the beams at screen center.

Alternatively, the three electron beams converged at the screen edges may be permitted to mis-converge at other locations over screen 22 and convergence of the displayed image may be provided by processing the red, green and blue image information that is applied to respective control grids of electron gun 12 for modulating the intensity of the red, green and blue electron beams and the intensity of the light produced by phosphors 23 in response thereto. Image processor 100 receives video image information generally referenced to a rectangular array of pixels corresponding on a one-to-one basis with the pixels of an image to be reproduced or displayed and provides to the control grids of electron gun 12 pixel information modified to correspond to the actual positional locations of the mis-converged electron beams. The stored image information of the array of pixel information as received is generally synchronized with the horizontal and vertical raster scanning of the image, e.g., as a number of rows of pixel information each comprising a large number of pixels.

Image processor 100 processes video or image information to produce three video signals R, G, B that differ from each other and from the input image information such that when the processed video signals are applied to the CRT, the image produced is corrected for mis-convergence that has not been removed by electron-optic convergence means, such as magnetic and/or electrostatic (M/E) convergence means. Image processor 100 may be as simple as a line store memory in which image information is written as received and from which image information for only two of the three beams is read and applied to a control grid of the electron gun at a time delayed from the nominal read-out time by an amount corresponding to the positional difference between the actual position of the electron beam and its nominal position. On the other hand, image processor 100 may be more complex for providing full raster and intensity mapping in two dimensions (e.g., horizontal scan and vertical scan).

Image processor 100 includes a memory storing information relating the known positional mis-convergence of each of the three red, green and blue electron beams to the known positions of the array of pixel information, and includes a processor for providing red, green and blue pixel information from the array of pixel information. The provided pixel information is modified by the stored positional misconvergence information such that the pixel information corresponding to a particular position on screen 22 is provided at the times corresponding to the respective electron beams being deflected to land at such particular position. In other words, registration of the red, green and blue images is provided by applying to the respective control grids of electron gun 12 at the same time, filtered signals corresponding to appropriately separated pixel positions read from the memory, wherein the separation is determined by the separation of the unregistered pixels on the screen 22 and vary as a function of the position of each respective beam on screen 22.

Image processor 100 may realign and/or register the pixels for a single line of pixel information, i.e., perform one-dimensional processing, or may realign and/or register the pixels for two or more lines of pixel information, i.e. two-dimensional processing. One-dimensional processing is satisfactory where magnetic deflection yoke 16 provides a raster scan that is substantially free of trapezoidal distortion so that the three electron beams essentially follow one another across the same horizontal scan line, and so only a line-store memory is needed. Two-dimensional processing is desirable where deflection yoke 16 is not free of trapezoidal distortion which results in the three electron beams scanning differently shaped scan patterns on screen 22 and so do not follow one another along the same scan line, e.g., the green beam scans out a substantially rectangular-like pattern and the red R and blue B beams scan respective left and right reversed trapezoids. A plural-line-store memory or a frame-store memory is desirable for two-dimensional processing.

It is noted that analysis of CRT deflection shows that where an electron gun and non-self converging deflection yoke are arranged so that the plural beams of electrons are substantially converged at or near one edge of the CRT faceplate (screen), they also are substantially converged at the opposite edge thereof, but are under-converged at the center of the screen. In general, the red electron beam begins its horizontal scan at the left edge of the screen with its highest velocity and finishes its scan at the left edge with its lowest velocity, while the blue electron beam begins its horizontal scan at the left edge of the screen with its lowest velocity and finishes its scan at the left edge with its highest velocity. Thus, the velocity profiles of the red and blue beams are symmetrical, but opposite, and the average velocity of each will be substantially that of the green (center) beam which has a relatively constant velocity across the screen. The horizontal position X and velocity V of each beam may be expressed by the relationships:

$$X_G=t \quad V_G=1$$

$$X_R=(1+4\Delta)t-4\Delta t^2 \quad V_R=1+4\Delta-8\Delta t$$

$$X_B=(1+4\Delta)t+4\Delta t^2 \quad V_B=1-4\Delta+4\Delta t^2$$

where $X_G=X_R=X_B=0$ at the left edge and $X_G=X_R=X_B=1$ at the right edge, t is time during the horizontal scan, and $\Delta$ is the free-fall separation (under-convergence) of the R, G, B beams at screen center.

It is also noted that tube 10 may also be advantageous because it "looks like a conventional CRT" with a shaped glass bulb and neck, and a planar or slightly curved faceplate, and so may utilize similar manufacturing processes as are utilized for conventional CRTs. The space charge effects that expand the electron beam are also similar to those in conventional CRTs and so the spot size variation with a smaller spot at the center of the faceplate and a somewhat larger spot size at the edges and corners is similar to that of the conventional CRT, although the structure and operation of tube 10 is very different therefrom. While the substantially reduced front-to-back depth of tube 10 is in the conical section of the glass bulb, the length of the tube neck 14 necessary to contain electron gun 12, typically less than about 23–25 cm (about 9–10 inches), can be reduced if a shorter electron gun 12 is employed.

As used herein, "generally rectangular shape" or "substantially rectangular" refers to a shape somewhat reflective of the shape of faceplate 20 and/or the cross-section of tube envelope 40 when viewed in a direction along Z axis 13. A generally rectangular shape may include rectangles and squares having rounded corners as well as concave and/or convex sides, so as to be suggestive of racetrack shapes, oval shapes and the like. It is noted that by so shaping electrodes 44, 46 and/or 48, the required waveform of the drive current applied to yoke 16 may be simplified, i.e. made closer to a linear waveform. Electrodes 44, 46, 48 may be oval in shape or even almost circular, particularly where the cross-section of tube envelope 40 is of such shape, e.g., at the portions thereof proximate neck 14 and yoke 16.

Figure 4:
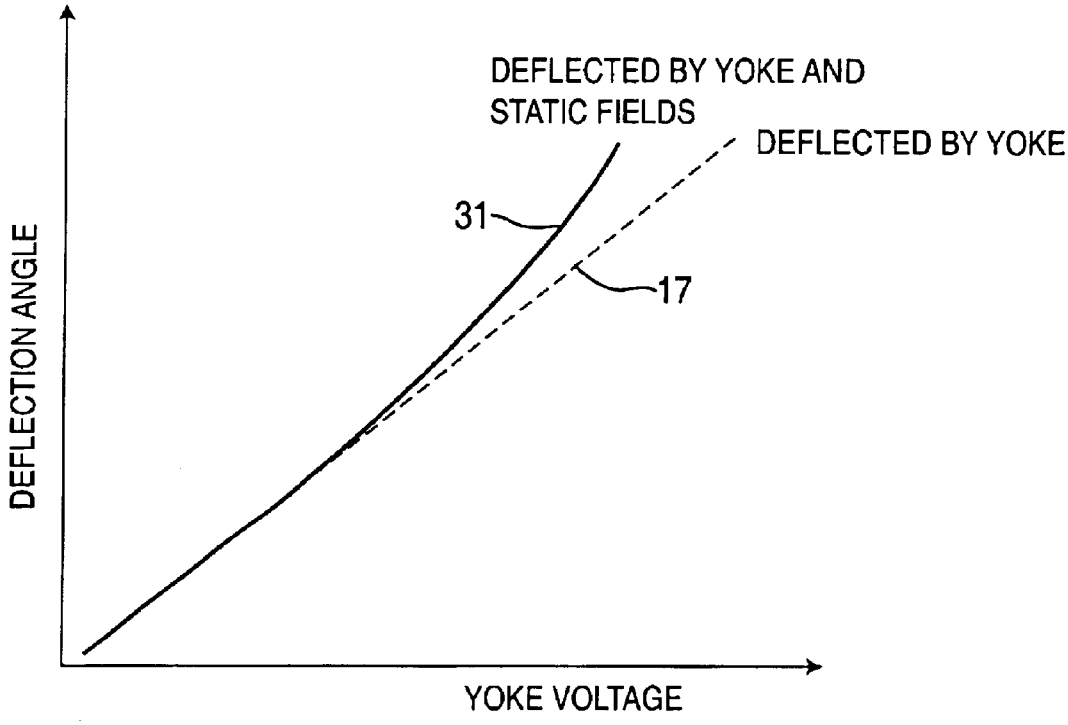
FIG. 4 is a graphical representation illustrating the performance of the cathode ray tube of FIG. 1.

The total deflection angle obtained is the sum of the magnetic deflection angle and the additional electrostatic deflection angle. The magnetic deflection angle is directly proportional to the deflection current/voltage applied to yoke 16 as illustrated by dashed line 17 of FIG. 4 and the additional electrostatic deflection angle is greater for greater magnetic deflections, producing line 31 representing the total deflection angle. The deflection amplifying effect results from the electric field produced by electrode 46 acting on electron beam 30 to produce a net electrostatic force (integrated over the electron path) that pulls the electrons away from centerline 13 of tube 10, thereby increasing the total deflection angle. This effect is aided by the bias potential on electrode 46 being greater than the potential of screen electrode 22.

Figure 5A:
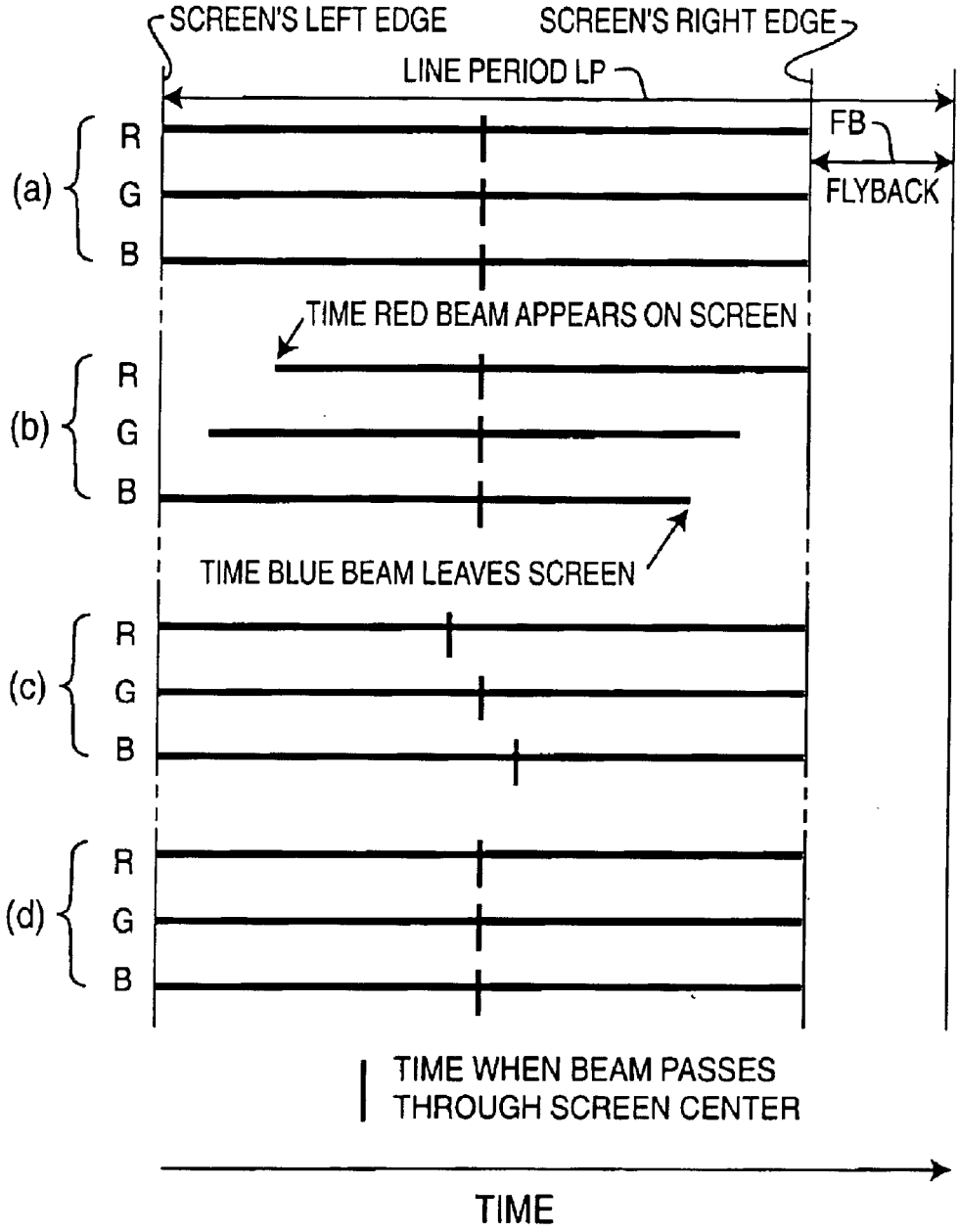
FIGS. 5A and 5B are graphical representations illustrating four different exemplary horizontal line scans of three electron beams across the screen of a CRT and the relative positions of the three beams at a given point in time.
Figure 5B:
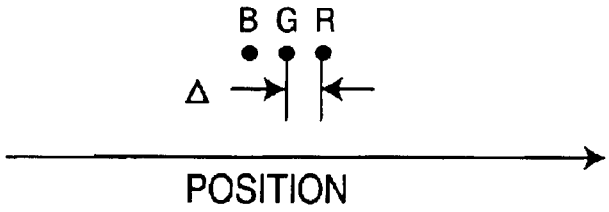

FIGS. 5A and 5B are graphical representations illustrating four different exemplary horizontal line scans of three electron beams R, G, B across the screen of a CRT 10 and the relative positions of the three beams R, G, B at a given point in time, assuming that the red beam exits from the right-hand side of the electron gun as viewed looking towards the electron gun from the screen. Each representation (a), (b), (c) and (d) of FIG. 5A, depicts a time period including one horizontal line scan, i.e. the predetermined line period LP, during which the electron beam lands on the CRT screen between its left and right edges as labeled for a portion of the line period LP and is off the screen during a flyback period FB. The on-screen time of each of electron beams R, G, B is represented by a heavy horizontal line on which is imposed a short vertical line indicating the time at which the beam lands at the center of the screen.

Case (a) represents one horizontal line scan of the desired or ideal condition wherein all three beams are converged at the left and right edges of the screen at the same time and also are converged to pass through the screen center at the same time which is halfway between the edge times. In other words, the beams are properly converged across the entire width of the screen and move in synchronism at a relatively constant rate. As a result, the on-screen time is maximized at the line period LP less the flyback time FB. Case (a) is in practice most closely approached by a self-converged yoke or by a non-self-converged yoke utilizing conventional magnetic or electrostatic dynamic convergence.

Case (b) represents one line scan for the case wherein a non-self-converging yoke is employed, whereby the three beams are free-fall converged at screen center and are mis-converged over the remainder of line period LP. As a result, the on-screen time of each beam is substantially less than the maximum possible on-screen time, i.e. the line period LP less the flyback time FB. In a typical example, the on-screen time of case (b) can be about 20% less than that of case (a), thereby producing a corresponding 20% loss of image brightness. At the left edge of the screen where the scan begins, the red and green beams R, G are to the left of the edge of the screen when the blue beam B begins its on-screen scan (and so are over-converged). At the right edge of the screen, the green and blue beams G, B are "off" the right edge of the screen when the red beam R reaches the right edge (and so is over-converged). Thus all three beams must be over-scanned to produce a complete image, and such over-scanning is wasteful of image-producing time to the detriment of image brightness.

Case (c) represents one line scan for the case wherein a non-self-converging yoke that converges all three beams at the edges of the screen according to the invention is employed. As a result, the on-screen time of each beam is substantially the maximum possible on-screen time, i.e. the line period LP less the flyback time FB, however, the three beams R, G, B are somewhat mis-converged at screen center. In a typical example, the mis-convergence is much less than for case (b), as represented by the three short vertical lines being closer together in case (c) that are the ends of the three horizontal lines R, G, B in case (b). Image processor 100 described herein provides compensating realignment and/or registration of the image pixel information for producing a desired image with mis-convergence as represented by case (c).

Case (d) represents one horizontal line scan for the case wherein the non-self-converging deflection yoke of case (c) is free-fall converged at the screen edges and wherein further magnetic and/or electrostatic (M/E) convergence means as described above provides convergence at screen center.

FIG. 5B depicts representative relative positions of mis-converged red R, green G and blue B spots along a horizontal line scan through screen center for defining a quantity Δ for the spacing between two adjacent ones of the red R, green G and blue B spots.

Figure 6:
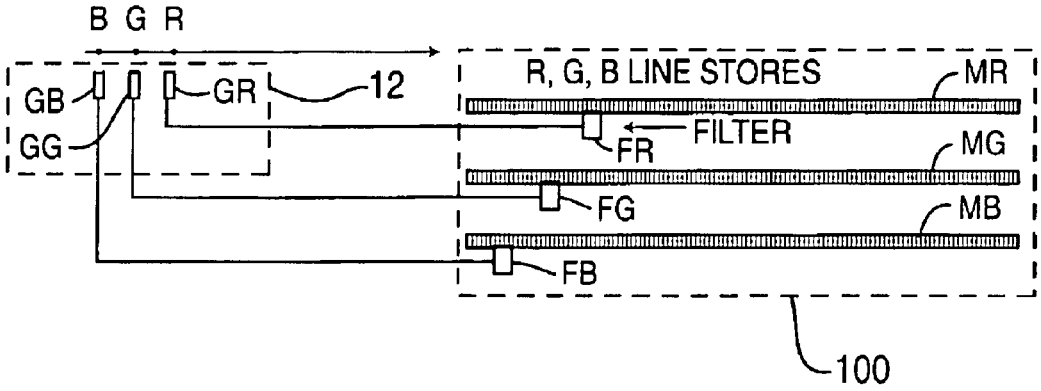
FIG. 6 is a representational schematic diagram illustrating a relationship between a memory and a scan line as in FIG. 5A.

FIG. 6 is a representational schematic diagram illustrating a relationship between a memory MR, MG, MB of processor 100 and a scan line SL as in FIG. 5A. Memory MR stores image information corresponding to the red pixels of one horizontal scan line of red image information, memory MG stores image information corresponding to the green pixels of one horizontal scan line of green image information, and memory MB stores pixel information corresponding to the blue pixels of one horizontal scan line of blue image information. Filters FR, FG, FB are illustrated at positions along the length of the respective memory MR, MG, MB to indicate that the image information provided to each of filters FR, FG, FB at any given time may correspond to different times along a horizontal scan line and to different positions of the electron beam R, G, B along the length of the horizontal scan line. As a result, each of spots R, G, B can be modulated by image information independently of the others thereof so that there is no longer any need for the three spots to scan in a converged condition to properly reproduce the desired image and to maximize the on-screen time of each spot, and therefore, the brightness of the image.

At a given time, pixel information for certain pixels is read from each memory MR, MG, MB by a respective corresponding filter FR, FG, FB to provide image control signals to the respective control grids GR, GG, GB of electron gun 12 to produce red R, green G and blue B spots of desired intensity of scan line SL. Because spots R, G, B are mis-converged, i.e. are at the given time at different positions along scan line SL, pixel data is read from the different respective portions of memory MR, MG, MB that correspond to the position of the spot R, G, B along scan line SL rather than the time. This is represented in FIG. 6 by filter FR being further to the right along the right-to-left length of memory than is filter FG along memory FG and filter FR along memory MB, each corresponding to the relatively more rightward position of the corresponding spot R relative to spot G and relative to spot B.

In other words, a processor comprises a memory for storing pixel values of an image from a given line of a first raster, and a filter coupled to the memory for selectively combining at least a portion of the stored pixel values to provide pixel values of the image for a given line of a second raster. However, the positions of the pixels of the given line of the first raster are not linearly related to positions of the pixels of the given line of the second raster, e.g., due to the different scan velocity profiles of the non-converged electron beams.

Figure 7:
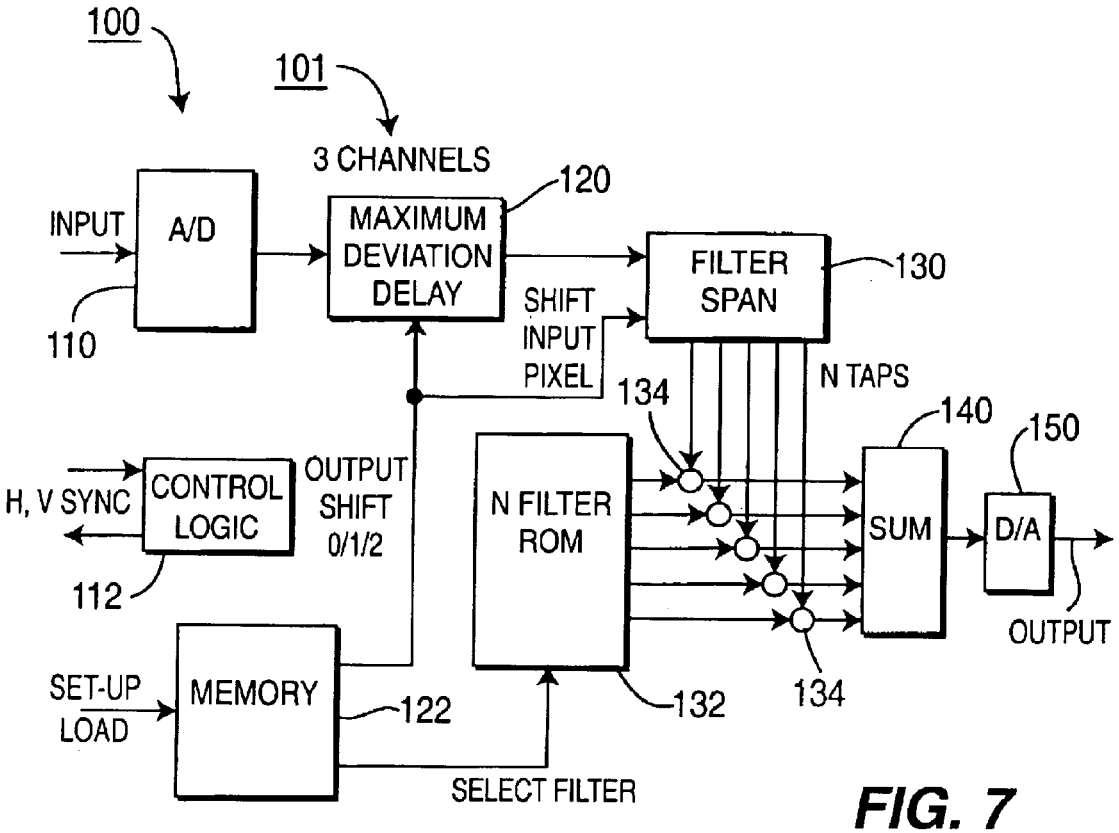
FIGS. 7 and 8 are schematic block diagrams of exemplary image processors providing so-called one-dimensional processing in accordance with the invention.
Figure 8:
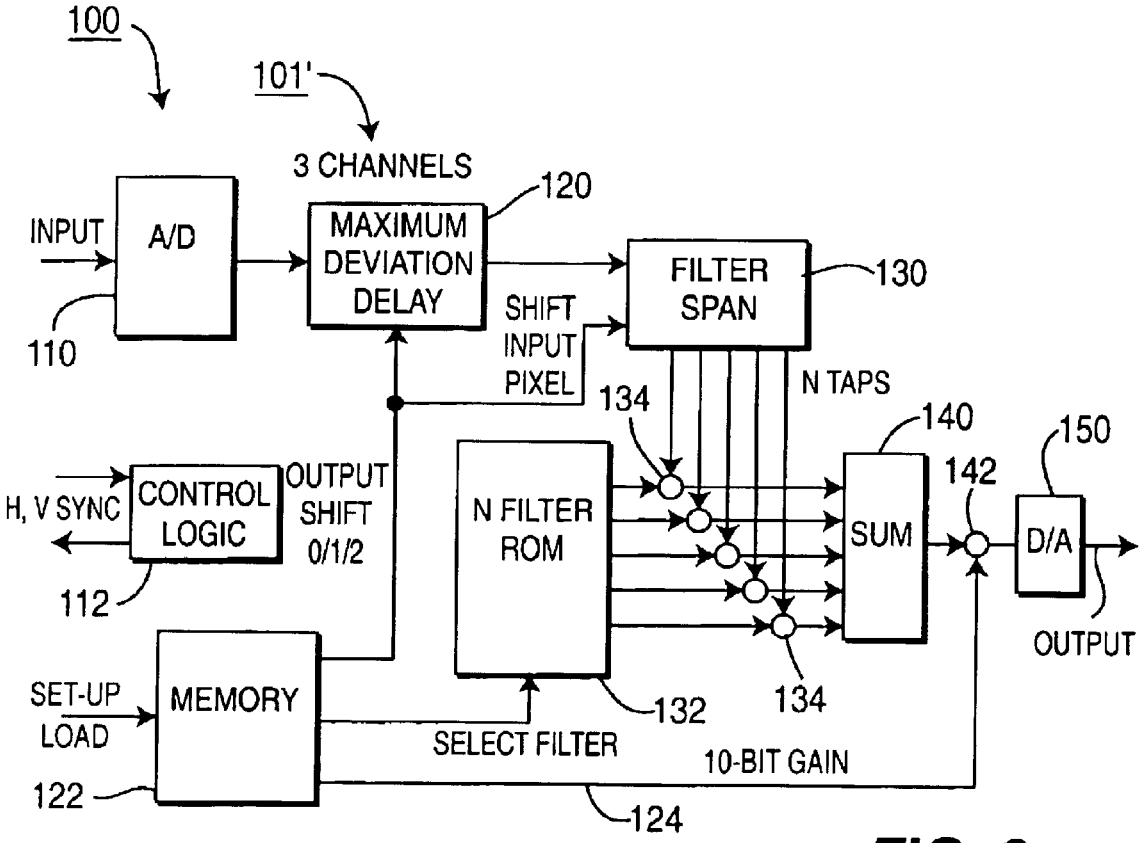

FIGS. 7 and 8 are schematic block diagrams of exemplary image processors 100 providing so-called one-dimensional processing in accordance with the invention. Typically, three of processors 101 are provided for processing respective red, green and blue pixel values in parallel. Image processor 100 includes a one-dimensional processor 101 in which analog-to-digital converter 110 of 8–10-bit resolution converts received input band-limited analog video signals to digital image information values that are stored in a video line memory 120. Since the conversion and storing is performed at a uniform clock rate corresponding to a pixel interval, e.g., provided by control logic 112 in known relationship to the H horizontal and V vertical synchronization (sync) signals, the image is "mapped" as a rectangular array of picture elements (pixels), and the sampling rate corresponds to the number of pixels per horizontal line.

Because each of the R, G, B electron beams are differently deflected in a non-converging system, at least two of the three sets of digital color image information are mapped differently before being read out for producing an image, however, all three color image information values are processed so as to at least tend to equalize the processing delay thereof. Typically, although only the R and B pixels need be processed or re-mapped to correspond to their deflection relative to the G pixels, the G pixels are also processed so as to at least introduce a delay corresponding approximately to the time necessary for processing the R and B pixels. If the G beam deflection is non-linear, then the G pixels are further processed in like manner to the processing of the R and B pixels. Such arrangement is satisfactory for an image of about 2-megapixel resolution or greater produced on a typical 1920×1080 raster as is typical in HDTV television.

Such one-dimensional processing may comprise, and is sometimes referred to as, interpolation, i.e. interpolation of the values of pixels that are close together on one horizontal line. In addition, the processing or "re-mapping" may, and typically does, require the processing of "fractional pixel offsets" so as to avoid creating image artifacts, e.g., such as having diagonal straight lines be displayed as line segments resembling a lightning stroke. Thus an $N^{th}$ output pixel value may be produced from the $n.n^{th}$ input pixel value (e.g., the $234^{th}$ output pixel could come from the $185.25^{th}$ input pixel).

Typically, memory 120 need only be a first-in/first-out (FIFO) buffer memory that stores sufficient pixel values to encompass the maximum horizontal scan deviation (e.g., about 2Δ) between all three electron beams, which may be on the order of about 100 pixels. Pixel values are shifted through memory 120 and into filter span memory 130 which typically is a FIFO shift register that stores 3–15 pixels of information to be provided as data to the filter 132, 134, 140 next described. Pixel values are shifted through FIFO memory 120 and filter span shift register 130 at either 0, 1 or 2 shifts per pixel interval in response to output shift data 0/1/2 stored in memory 122 wherein the pixel shift data is defined by the relative scan positions of the three electron beams R, G, B over the area of the CRT screen. Typically, the pixel values are shifted at a rate of 1 pixel per time interval for most of the time intervals, as would be the case for a linear scan. As the pixel values need to be processed for differences on the respective scans, the pixels may either be clocked twice in one pixel interval (2 shifts) to advance or skip a clock in a pixel interval (0 shift) for as to be delayed.

Filter 130, 132, 134, 140 includes an "N-filter" read-only memory (ROM) 132 in which are stored an array of sets of filter coefficients (scaling values) defining values N for pixel filters including fractional pixel filters. An appropriate set of filter coefficients are selected in response from the "select filter" data from memory 122. Memory 122 stores the output shift values 0/1/2 and the select filter data of one or more horizontal scan lines and such data is developed and loaded based upon the mis-convergence of a CRT 10 and a non-self-converging deflection yoke 16, either on a uniform basis where the characteristics of the CRT 10 and yoke 16 are sufficiently uniform from unit to unit, or on a unique basis for each particular CRT 10 and yoke 16. Memory 122 is typically about a 2K×5-bit memory where the scan geometry of all the lines is the same or is a 2M×5 bit filter where a different value is needed for each pixel in a two-megapixel raster. The required capacity of memory 122 may be reduced in a particular embodiment by employing known memory techniques, such as interpolation between data points.

The select filter data selects the appropriate N-filter characteristic for each pixel interval, whether that be coefficients for an integral number of pixels or for a fractional number of pixels. For example, at the $M^{th}$ pixel from the beginning of a horizontal line, the advance is one pixel and ROM 122 produces the appropriate filter coefficients corresponding to an integral pixel, i.e. N=1. If the next interval is the M+0.25 pixel position, then the pixel values are shifted by 1 and ROM 122 produces the filter coefficients for the N=0.25 pixel spacing. If the next interval is the M+0.75 pixel position, then the pixel values are not shifted and ROM 122 produces the filter coefficients for the N=0.75 pixel spacing. Scaler 134, e.g. a set of multipliers 134, scales each of the pixel values from shift register 130 in accordance with the respective filter coefficients from memory 122 to produce scaled pixel values which are summed by summer 140 and converted to an analog signal by digital-to-analog converter 150 for application to the appropriate electron gun control grid as described above. ROM 132 typically stores sets of 4–5 bit coefficients for about 4–8 different fractional filters.

Control logic 112 delays the H horizontal and V vertical synchronization signals by a number of pixel intervals representative of the number of pixels that must be adjusted for properly providing pixel values for converging the images produced by scanning the three non-converged electron beams. For example, if the maximum positional deviation of any pixel is ±50 pixel positions, then the synchronization signals are delayed by 50 pixel intervals. Control logic 112 also provides clock and other control signals to the converters, memories, registers, scalers and the like illustrated.

One-dimensional image processor 101' of FIG. 8 is identical to processor 101 of FIG. 7 except that gain compensation multiplier 142 is interposed between summer 140 and D/A converter 150. The gain value provided to multiplier 142 from memory 122 adjusts the output pixel value for differences in the velocity of the electron beam to the extent that velocity differs at various positions of the raster. If the velocity is higher than nominal, then the electron beam illuminates a pixel phosphor for a shorter time thereby to decrease the brightness of that pixel, which is compensated by memory 122 providing a gain factor that is proportionately greater than unity. If the velocity is less than nominal, then the electron beam illuminates a pixel phosphor for a longer time thereby to increase the brightness of that pixel, which is compensated by memory 122 providing a gain factor that is proportionately lower than unity. For a 10-bit gain value, memory 122 is a 2K×15-bit memory or a 2M×15-bit memory depending upon deflection geometry as described above.

Figure 9:
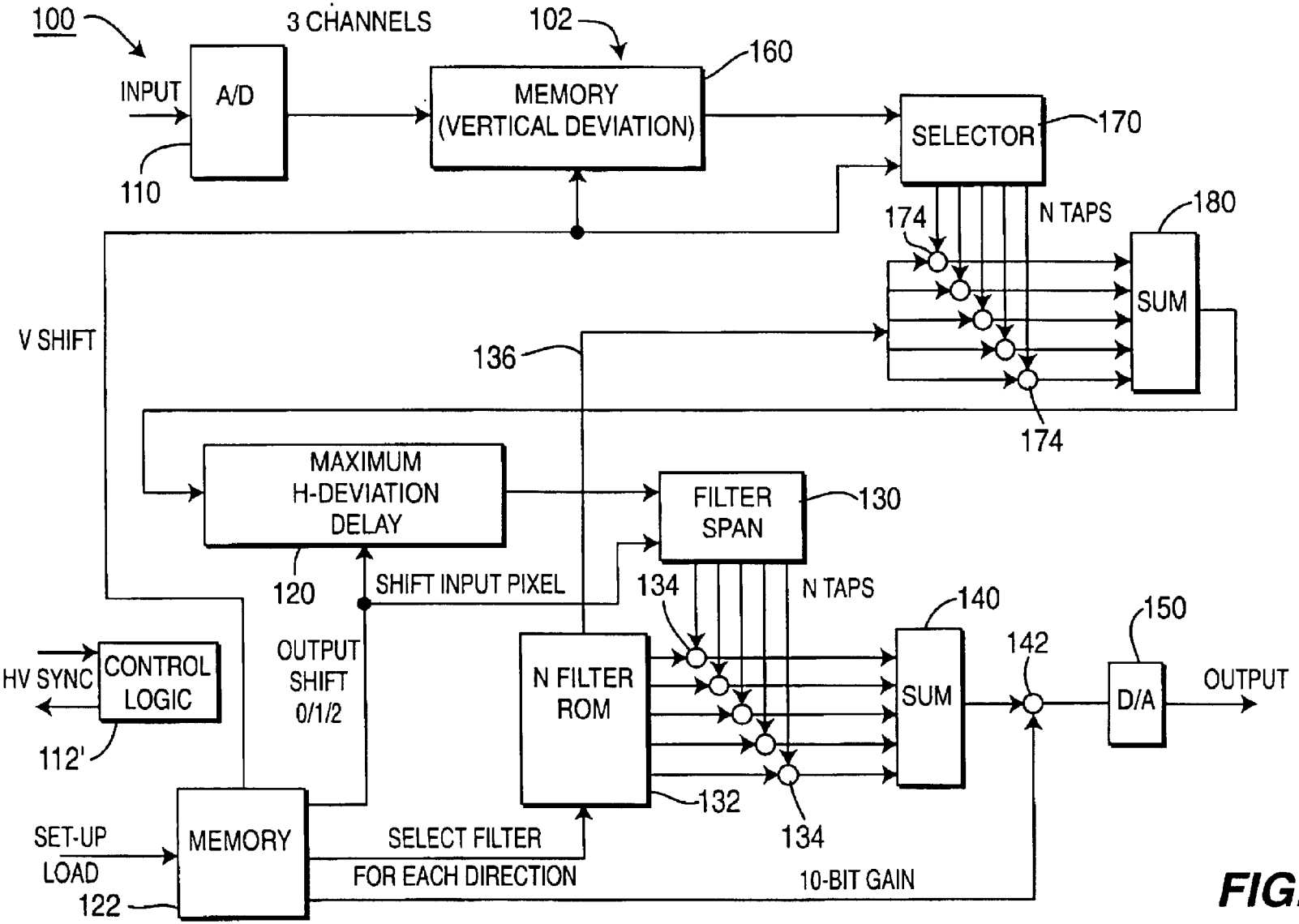
FIG. 9 is a schematic block diagram of an exemplary image processor providing so-called two-dimensional processing in accordance with the invention.

FIG. 9 is a schematic block diagram of a image processor 100 including a two-dimensional processor 102 providing so-called two-dimensional processing in accordance with the invention. Two dimensional processing includes the one-dimensional processing as described above, wherein like numbered elements of FIGS. 7–9 perform like functions, and also requires processing that includes two or more adjacent horizontal lines. In the exemplary embodiment of FIG. 9, for example, the digital image information (pixel values) are first processed to produce pixel information for a single horizontal line of pixels and that single-line pixel information is then processed to produce red, green and blue image information that is applied to the control grids of the electron gun 12. Such two-dimensional processing may comprise, or may be sometimes be referred to as, interpolation, i.e. interpolation of the values of pixels that are close together horizontally and vertically.

Typically, three of processors 102 are provided each for processing several lines of respective red, green and blue pixel values in parallel. In two-dimensional processor 102, analog-to-digital converter 110 of 8–10-bit resolution converts received input band-limited analog video signals to digital image information values that are stored in a plural-line video memory 160 of capacity for storing the pixel values comprising a plurality of horizontal scan lines. The number of lines is sufficient for including the maximum vertical mis-convergence deviation of the three electron beams from a horizontal line plus the number of pixels corresponding to the number of pixels of the span of the filter provided by selector 170 and N-filter ROM 122. Since the conversion and storing is performed at a uniform clock rate corresponding to a pixel interval, e.g., provided by control logic 112 in known relationship to the H horizontal and V vertical synchronization (sync) signals, the image is "mapped" as a rectangular array of picture elements (pixels), and the sampling rate corresponds to the number of pixels per horizontal line, as for processor 101 above.

Because each of the R, G, B electron beams are differently deflected both vertically and horizontally in a non-converging system including two-dimensional mis-convergence, at least two of the three sets of digital color image information are mapped differently over several lines before being read out for producing an image, however, all three color image information values are processed so as to at least tend to equalize the processing delay thereof.

Typically, although only the R and B pixels need be processed or re-mapped to correspond to their two-dimensional deflection relative to the G pixels, the G pixels are also processed so as to at least introduce a delay corresponding approximately to the time necessary for processing the R and B pixels. If the G beam deflection is non-linear, then the G pixels are further processed including plural lines of pixels in like manner to the processing of the R and B pixels. Such arrangement is satisfactory for an image of about 2-megapixel resolution or greater produced on a typical 1920×1080 raster as is typical in HDTV television.

In addition, the processing or "re-mapping" may, and typically does, require the processing of "fractional pixel offsets" in both the horizontal and vertical directions so as to avoid creating image artifacts, e.g., such as having diagonal straight lines be displayed as line segments resembling a lightning stroke. Such processing is similar in each of both the vertical and horizontal directions to the one-dimensional horizontal processing described above for processor 101. Thus a pixel value of the $M^{th}$ output line may be produced from the $m.m^{th}$ input pixel value (e.g., the pixel values of the $345^{th}$ output line could come from the $345.25^{th}$ input line) and, on any line, an $N^{th}$ output pixel value may be produced from the $n.n^{th}$ input pixel value (e.g., the $234^{th}$ output pixel could come from the $185.25^{th}$ input pixel).

Typically, memory 160 comprises a first-in/first-out (FIFO) buffer memory, i.e. an L-line shift register, that stores pixel values for a number L of lines of the image to encompass the vertical horizontal scan deviation between all three electron beams. For example, if the filter span of selector 170 is 7 lines and the maximum mis-convergence among the three electron beams is 16 lines, then memory 160 stores L=23 lines of pixel values. Pixel values for L lines are shifted through memory 160 such that when pixel values of each line are shifted out of the last register for that line they are shifted into the input register for the next line, whereby a set of corresponding sets of pixel values for the L lines are produced at the output of memory 160 and are shifted into the L lines of selector 160 which functions similarly to filter span memory 130 above.

Selector 170 is typically an L-line FIFO shift register that stores a number of pixels equal to the filter span for each of the pixels of information to be provided as data to the filter 136, 174, 180 next described. Pixel values are shifted through L-line FIFO memory 160 and L-line filter span selector shift register 160 and are selected for each pixel interval in response to data 136 stored in memory 122 wherein the line and pixel selection data is defined by the relative scan positions of the three electron beams R, G, B over the area of the CRT screen.

Filter 136, 170, 174, 180 is responsive to selector 170 span values provided from memory 122 and to an array of sets of filter selector coefficients (scaling values) defining scaling values 136 for multipliers 174 scaling the selected line pixel values produced by selector 170, thereby providing whole and fractional line filters similar to the fractional pixel filter described above. An appropriate set of filter selector coefficients are selected in response from the "select filter" data from memory 122. Memory 122 stores the selector values for one or more horizontal scan lines and such data is developed and loaded based upon the vertical mis-convergence of a CRT 10 and a non-self-converging deflection yoke 16, either on a uniform basis where the characteristics of the CRT 10 and yoke 16 are sufficiently uniform from unit to unit, or on a unique basis for each particular CRT 10 and yoke 16. The select filter data produced by N-filter memory 132 also selects the appropriate N-filter characteristic for filter 136, 170, 174, 180 for each pixel interval, whether that be coefficients for an integral number of lines/pixels or for a fractional number of lines/pixels. Scaler 174, e.g. a set of multipliers 174, scales each of the pixel values from selector shift register 170 in accordance with the respective filter coefficients 136 from memory 132 to produce scaled pixel values which are summed by summer 180 to produce a processed set of pixel values corresponding to one horizontal line of pixels. ROM 132 typically stores sets of 4–5 bit scaling coefficients for about 4–8 different fractional line filters. Control logic 112, as above, provides clock and other control signals to the converters, memories, registers, scalers and the like illustrated.

The pixel values for one horizontal line produced at the output of summer 180 provides the input to a one-dimensional processor comprising horizontal deviation delay shift register 120, filter span 130, memory 122, N-filter ROM 132, scalers 134, summer 140 and D/A converter 150 that is a one-dimensional processor 101, or with gain scaler 142 is a processor 101', as described above.

It is noted that in both one-dimensional and two-dimensional processing, a given point or position on the screen is illuminated at different instants of time by the red, green and blue electron beams, because the three beams are not converged so as to land on the same spot on the screen. This is different from conventional cathode ray tubes in which the three beams are converged to land on the same spot on the screen at the same instant of time, and so the red, green and blue electron beams simultaneously illuminate each given point or position on the screen as they are scanned across the screen. In this embodiment, the differences in time between when each of the three beams illuminate any point or position on the screen are sufficiently small, typically on the order of a few microseconds, that proper color mixing (e.g., color and tint) is correctly perceived visually by a human viewer.

Figure 10:
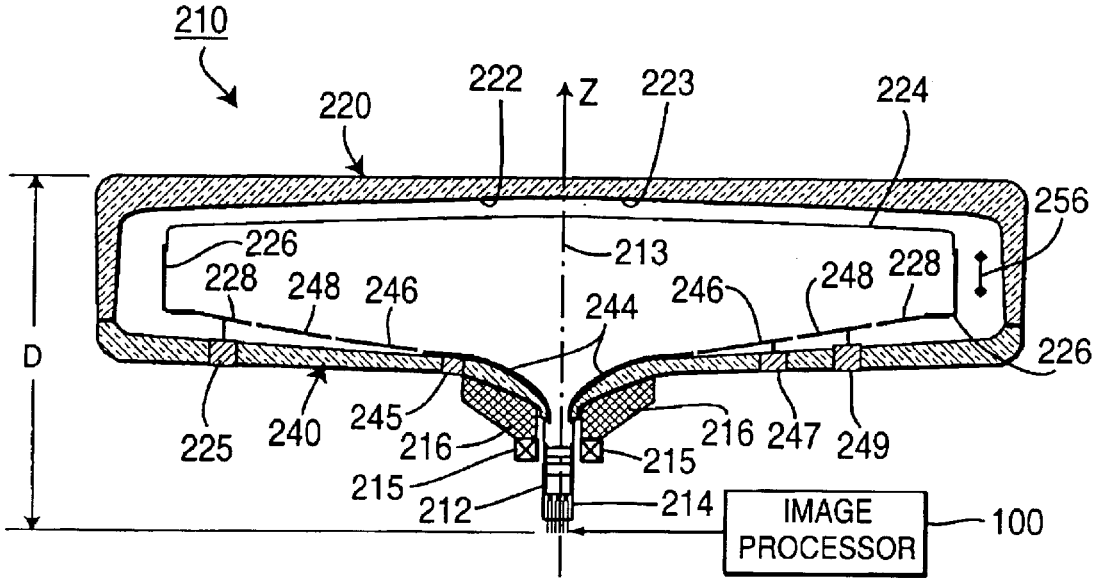
FIGS. 10 and 11 are cross-sectional diagrams illustrating alternative exemplary embodiments of arrangements providing appropriately positioned electrodes within a cathode ray tube in accordance with the invention.

FIG. 10 is a cross-sectional diagram of an alternative exemplary cathode ray tube 210 showing an alternative arrangement for appropriately positioning a set of electrodes 244, 246, 248 mounted within the interior of funnel-shaped glass bulb 240 to deflect an electron beam (not shown) to land on screen electrode 222 and phosphors 223 as described above in relation to tube 10. Electron gun 212, neck 214, faceplate 220, phosphors 223, shadow mask 224, mask frame 226, and funnel-shaped glass bulb 240 are disposed symmetrically relative to centerline 213, and may include a getter material 256 in a convenient location in the space between glass bulb 240 and one or more of metal electrodes 246, 248, mask frame 226 and mask frame shield 228, all of the foregoing being substantially as described above.

Stamped metal mask shield 228 and stamped metal electrodes 246, 248 are formed as a set of mirror-image plates and/or loops of ascending dimension and are positioned symmetrically with respect to tube central axis 213 with the smallest proximate neck 214 and the largest proximate mask frame 226 and faceplate 220. Mask frame 226 is a relatively rigid metal structure attached to the interior of faceplate 220, such as by metal clips or by embedment in glass support features such as glass beads or lips on the interior surface of faceplate 220, and provides support for mask shield 228 and for electrodes 246 and 248 attached thereto Typically, two or more supports 252 (not visible in FIG. 10) of an insulating material bridge the gap between mask shield 228 and electrode 248 for providing electrically insulating support therebetween to hold mask shield 228 and electrode 248 in a desired relative position. Similarly, two or more additional supports 252 (not visible in FIG. 10) of an insulating material bridge the gap between electrode 246 and electrode 248 for providing electrically insulating support therebetween to hold electrode 246 and 248 in a desired relative position. Each of mask shield 228 and electrodes 246, 248 is electrically isolated from the other ones thereof, unless it is desired that two or more of mask shield 228 and electrodes 246, 248 be at the same bias potential.

In a typical tube 210 having an about 81 cm (about 32-inch) diagonal faceplate 220 in a 16:9 wide-format aspect ratio, depth D is about 28 cm (about 11 inches). Screen 222, mask 224, mask support 226 and mask shield 228 are biased to a potential of about 28–32 kV, and typically 30 kV, via high-voltage conductor 225 (i.e. "button" 225) penetrating glass bulb 240. Coated neck region electrode 244 is biased in a range of about 18–24 kV, typically 22 kV, applied via button 245. High voltage electrode 246 is biased to a potential higher than the screen bias potential in a range of about 30–35 kV, typically 35 kV, applied via button 247, for increasing the electron-beam deflection provided by deflection yoke 216. Electrode 248 is biased to a potential less than the screen bias potential in a rang of about 18–24 kV, typically 22 kV, applied via button 249, for directing the electron beam in the peripheral region near the edges of faceplate 220 towards faceplate 220.

Figure 11:
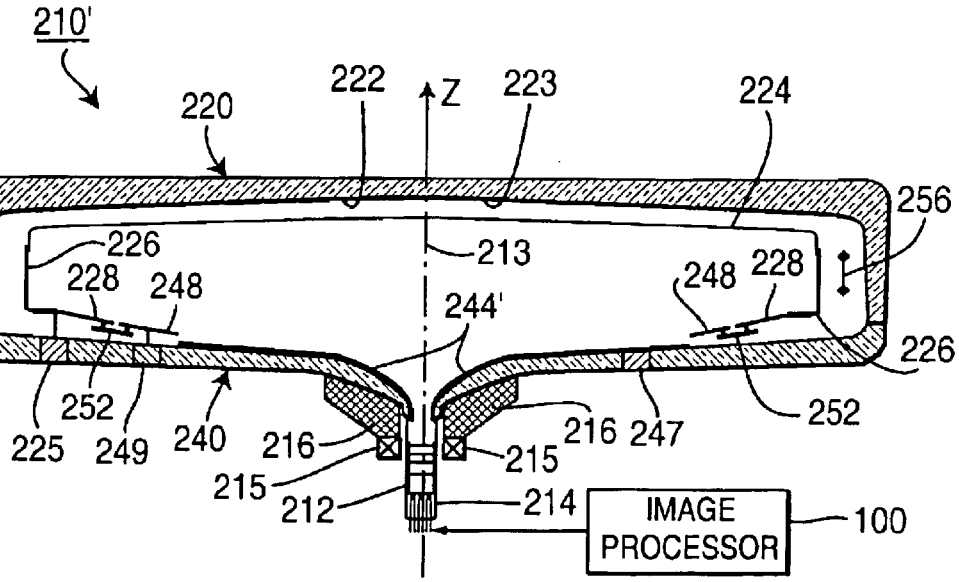

FIG. 11 is a cross-sectional diagram illustrating alternative exemplary arrangement of appropriately positioned electrodes 244, 248 within a cathode ray tube 210' in accordance with the invention. Tube 210' is like tube 210 of FIG. 10 except that stamped metal electrode 246 is eliminated and coated neck electrode 244' extends to cover the portion of the interior surface of glass bulb 240 that was behind and thus shielded by electrode 246 in tube 210. Visible therein is support 252 which is typically a ceramic support fused or otherwise attached to mask shield 228 and electrode 240 for supporting same in desired relative positions.

Neck electrode 244' is biased at the same potential as is screen electrode 222 in tube 210 and may extend to carry such bias potential applied via button 245 to screen electrode 222, mask 224, mask frame 226 and mask shield 228, e.g., such as via a metal clip thereon or other connection. Electrode 248 is biased via button 249 in like manner to tube 210. in any of the tubes 10, 210, 210' and so on, high voltage feedthrough buttons 25, 45, 47, 49, 225, 245, 247, 249 may be positioned to penetrate glass tube envelope 40, 240 at any convenient location.

Figure 12:
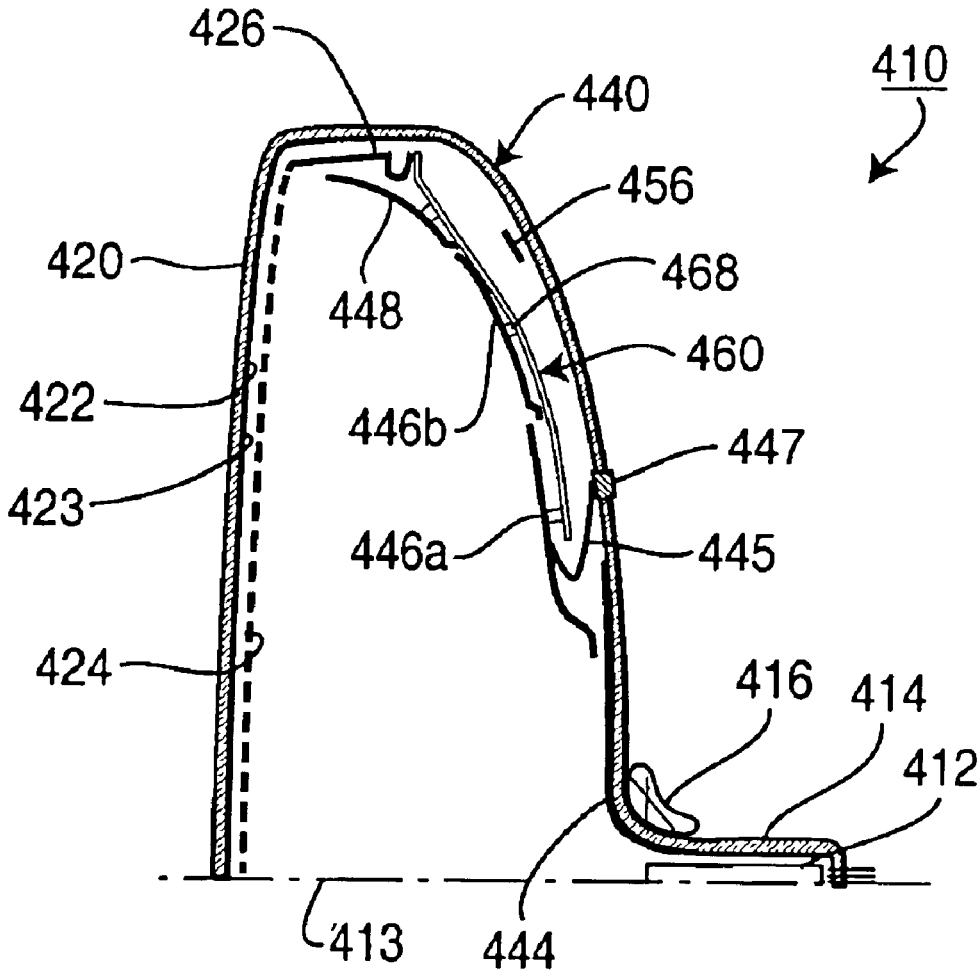
FIG. 12 is a partial cross-sectional diagram of an alternative exemplary structure providing appropriately positioned electrodes within a cathode ray tube in accordance with the invention.

FIG. 12 is a partial cross-sectional diagram of an alternative exemplary structure providing appropriately positioned electrodes 446*a*, 446*b*, 448 within a cathode ray tube 410 in accordance with the invention. Faceplate 420, glass tube bulb 440, neck 414, electron gun 412, magnetic deflection yoke 416, faceplate 420, screen electrode 422, phosphors 423, shadow mask 424, and shadow mask frame 426 are as described above in relation to tube 10.

Sprayed or deposited neck electrode 444 is biased at a potential not exceeding the screen potential, and preferably less than screen potential, e.g., typically 10 . 20 kV and typically 15 kV. Plural electrostatic deflection electrodes 446*a*, 446*b*, 448 are adapted to be biased at different potentials and are spaced away from the wall of tube envelope 440 and attached to support member 460 by respective welds 468. A high positive potential, e.g., 35 kV, is applied via feedthrough 447 and electrically-conductive support 445 to electrode 446*a* for increasing the deflection of electrons highly deflected by deflection yoke 416. Support member 460 includes a voltage divider as described above to develop bias potentials for electrodes 446*b* and 448. Electrode 448 is biased to a potential less than the screen potential, e.g., 0–20 kV and typically 10 kV, while electrode 446*b* may be biased to the potential of electrode 446*a* or that of electrode 448, e.g., 35 kV and 10 kV, respectively. Getter material 456 is positioned as convenient behind electrodes 446*a*, 446*b*, 448 and support 460.

While the present invention has been described in terms of the foregoing exemplary embodiments, variations within the scope and spirit of the present invention as defined by the claims following will be apparent to those skilled in the art. For example, any one or more or all of electrodes 44, 46, 48 may be biased at the same potential as is the screen 22 of the CRT according to the invention, or may be replaced by an electrically-conductive coating or by regions of electrically-conductive coatings each of which may be biased to the screen potential or to one or more potentials that are greater or less than the screen potential. In fact, the CRT need not be a space-saving type of CRT but the invention may be utilized with a conventional CRT in combination with a non-self-converging deflection yoke.

With regard to processor 100, it is noted that other signals may be provided as desired. For example, signals representative of temperature, bias potentials and other voltages, magnetic field strength and the like may be utilized. Further, while the input video signals are typically low-level analog signals for the red, green and blue images, they need not be, but may be digital signals or high-level signals or any other signal by which image information may be represented.

While the bias potential applied to the peripheral electrode 48 is preferably less than the screen potential, it may be equal thereto, may be less than the bias potential of neck electrode 44 and may even be at zero or ground potential or negative.

Alternatively to providing separate high-voltage button feedthroughs penetrating the glass wall of the cathode ray tube, one or more of supports for ones of electrodes 46 and 48 may include a high-resistivity electrical conductor, such as ruthenium oxide, typically formed in a serpentine pattern on a ceramic layer to provide resistors having a high resistance, e.g., on the order of $10^9$ ohms, that together form a resistive voltage divider that apportions the bias potential applied at a feedthrough to develop the desired bias potential for each one of electrodes 44, 46, 48.

What is claimed is:

1. A cathode ray tube comprising:

a tube envelope having a faceplate and a screen electrode on the faceplate configured to be biased at a screen potential;

a source of a beam of electrons directed toward said faceplate, wherein said source is configured for magnetic deflection of said beam of electrons;

a non-self converging deflection yoke proximate said source of a beam of electrons for magnetically deflecting said beam of electrons;

wherein said source of a beam of electrons and said non-self converging deflection yoke are configured to substantially converge the beam of electrons when the deflected beam of electrons is at or near two opposing edges of said faceplate, rather than at or near the center of said faceplate;

phosphorescent material disposed on said faceplate for producing light in response to the beam of electrons impinging thereon; and a first electrode interior said tube envelope, said first electrode defining an aperture through which the beam of electrons passes, wherein said first electrode is intermediate said deflection yoke and said faceplate and is configured to be biased at a potential one of greater than and less than the screen potential.

2. The cathode ray tube of claim 1 further comprising a second electrode defining an aperture through which the beam of electrons passes, wherein said second electrode is between said first electrode and said faceplate, wherein said first electrode is configured to be biased at a potential greater than the screen potential and wherein said second electrode is configured to be biased at a potential less than the screen potential.

3. The cathode ray tube of claim 1 wherein said first electrode includes a one of a conductive material on an interior surface of said tube envelope and a formed metal electrode adjacent the interior surface of said tube envelope.

4. The cathode ray tube of claim 1 further comprising a shadow mask proximate said faceplate having a plurality of apertures therethrough, said shadow mask configured to be biased at the screen potential, and wherein said phosphorescent material includes a pattern of different phosphorescent materials on said faceplate that emit different color light in response to the beam of electrons impinging thereon through the apertures of said shadow mask.

5. A display comprising:

a tube envelope having a faceplate and a screen electrode on the faceplate biased at a screen potential;

a source within said tube envelope of plural beams of electrons directed toward said faceplate;

a non-self-converging deflection yoke proximate said source of plural beams of electrons for magnetically deflecting the plural beams of electrons;

wherein said source of plural beams of electrons and said non-self converging deflection yoke are configured to substantially converge the plural beams of electrons when the deflected plural beams of electrons are at or near two opposing edges of said faceplate, rather than at or near the center of said faceplate;

phosphorescent material disposed on said faceplate for producing light in response to the plural beams of electrons impinging thereon;

a first electrode within said tube envelope, said first electrode defining an aperture through which the deflected plural beams of electrons pass, wherein said first electrode is intermediate said deflection yoke and said faceplate and is biased at a first potential one of greater than and less than the screen potential; and a source of potential providing the first and screen potentials.

6. The display of claim 5 further comprising a processor coupled to said source of plural beams of electrons for providing image information for controlling the plural beams of electrons, said processor changing image information from a first raster corresponding to position of an image to a second raster corresponding to position of the plural beams of electrons on said faceplate when deflected by said non-self-converging deflection yoke.

7. The display of claim 6 wherein said processor is one of a one-dimensional processor and a two-dimensional processor.

8. The display of claim 6 wherein said processor is responsive to pixel values of the image from one line of the first raster to provide pixel values of the image for one line of the second raster.

9. The display of claim 6 wherein said processor is responsive to pixel values of the image from plural adjacent lines of the first raster to provide pixel values of the image for one line of the second raster.

10. The display of claim 6 wherein said processor is responsive to pixel values of the image from plural adjacent lines of the first raster to provide pixel values of the image for one line of a third raster and is responsive to the pixel values of the image from the one line of the third raster to provide pixel values of the image for one line of the second raster.

11. The display of claim 5 further comprising a shadow mask proximate said faceplate having a plurality of apertures therethrough, wherein said shadow mask is biased at the screen potential, and wherein said phosphorescent material includes a pattern of different phosphorescent materials on said faceplate that emit different color light in response to the plural beams of electrons impinging thereon through the apertures of said shadow mask.

12. The display of claim 5 further comprising a second electrode defining an aperture through which the plural beams of electrons pass, wherein said second electrode is between said first electrode and said faceplate, wherein the first potential is greater than the screen potential and wherein said second electrode is biased to a potential less than the screen potential.

13. The display of claim 12 wherein said first and second electrodes each include one of a conductive material on an interior surface of said tube envelope and a formed metal electrode adjacent the interior surface of said tube envelope.

14. A display comprising:

a tube envelope having a faceplate and a screen electrode on the faceplate configured to be biased at a screen potential;

a source within said tube envelope of plural beams of electrons directed toward said faceplate;

a non-self-converging deflection yoke proximate said source of plural beams of electrons for magnetically deflecting the plural beams of electrons, wherein said non-self converging deflection yoke substantially converges the plural beams of electrons near two opposing edges of said faceplate;

phosphorescent material disposed on said faceplate for producing light in response to the plural beams of electrons impinging thereon; and a processor coupled to said source of a beam of electrons for providing image information for controlling the plural beams of electrons, said processor changing image information from a first raster corresponding to position of an image to a second raster corresponding to position of the plural beams of electrons on said faceplate when deflected by said non-self-converging deflection yoke.

15. The display of claim 14 wherein said processor is one of a one-dimensional processor and a two-dimensional processor.

16. The display of claim 14 wherein said processor is responsive to pixel values of the image from one line of the first raster to provide pixel values of the image for one line of the second raster.

17. The display of claim 16 wherein said processor comprises a first memory for storing the pixel values of the image from one line of the first raster, and a filter for selectively combining at least a portion of the stored pixel values to provide the pixel values of the image for the one line of the second raster.

18. The display of claim 14 wherein said processor is responsive to pixel values of the image from plural adjacent lines of the first raster to provide pixel values of the image for one line of the second raster.

19. The display of claim 18 wherein said processor comprises a first memory for storing the pixel values of the image from plural adjacent lines of the first raster, and a filter for selectively combining at least a portion of the stored pixel values to provide the pixel values of the image for the one line of the second raster.

20. The display of claim 14 wherein said processor is responsive to pixel values of the image from plural adjacent lines of the first raster to provide pixel values of the image for one line of a third raster and is responsive to the pixel values of the image from the one line of the third raster to provide pixel values of the image for one line of the second raster.

21. A display comprising:

a tube envelope having a faceplate and a screen electrode on the faceplate configured to be biased at a screen potential;

a source within said tube envelope of plural beams of electrons directed toward said faceplate;

a non-self-converging deflection yoke proximate said source of plural beams of electrons for magnetically deflecting the plural beams of electrons, wherein said non-self converging deflection yoke substantially converges the plural beams of electrons near two opposing edges of said faceplate;

phosphorescent material disposed on said faceplate for producing light in response to the plural beams of electrons impinging thereon; and a processor coupled to said source of a beam of electrons for providing image information for controlling the plural beams of electrons, said processor changing image information from a first raster corresponding to position of an image to a second raster corresponding to position of the plural beams of electrons on said faceplate when deflected by said non-self-converging deflection yoke, wherein said processor is responsive to pixel values of the image from one line of the first raster to provide pixel values of the image for one line of the second raster, wherein said processor comprises a first memory for storing the pixel values of the image from one line of the first raster, and a filter for selectively combining at least a portion of the stored pixel values to provide the pixel values of the image for the one line of the second raster, and wherein said first memory comprises a shift register for storing the pixel values from the one line of the first raster, and wherein said filter comprises a scaler coupled to said shift register for scaling at least a selected portion of the stored pixel values, and a combiner coupled to said scaler to provide the pixel values for the one line of the second raster.

22. A display comprising:

a tube envelope having a faceplate and a screen electrode on the faceplate configured to be biased at a screen potential;

a source within said tube envelope of plural beams of electrons directed toward said faceplate;

a non-self-converging deflection yoke proximate said source of plural beams of electrons for magnetically deflecting the plural beams of electrons, wherein said non-self converging deflection yoke substantially converges the plural beams of electrons near two opposing edges of said faceplate;

phosphorescent material disposed on said faceplate for producing light in response to the plural beams of electrons impinging thereon; and a processor coupled to said source of a beam of electrons for providing image information for controlling the plural beams of electrons, said processor changing image information from a first raster corresponding to position of an image to a second raster corresponding to position of the plural beams of electrons on said faceplate when deflected by said non-self-converging deflection yoke, wherein said processor is responsive to pixel values of the image from plural adjacent lines of the first raster to provide pixel values of the image for one line of the second raster, wherein said processor comprises a first memory for storing the pixel values of the image from plural adjacent lines of the first raster, and a filter for selectively combining at least a portion of the stored pixel values to provide the pixel values of the image for the one line of the second raster, and wherein said first memory comprises a shift register for storing the pixel values from the plural adjacent lines of the first raster, and wherein said filter comprises a scaler coupled to said shift register for scaling at least a selected portion of the stored pixel values, and a combiner coupled to said scaler to provide the pixel values for the one line of the second raster.

23. The display of claim 22 wherein said processor further comprises a second memory for storing the pixel values of the image from the one line of the second raster, and a second filter for selectively combining at least a portion of the pixel values stored in said second memory to provide modified pixel values of the image for the one line of the second raster.

24. The display of claim 23 wherein said second memory comprises a second shift register for storing the pixel values from the one line of the second raster, and wherein said second filter comprises a second scaler coupled to said second shift register for scaling at least a selected portion of the pixel values stored in said second shift register, and a second combiner coupled to said second scaler to provide the modified pixel values for the one line of the second raster.

25. A processor comprising a memory for storing pixel values of an image from a given line of a first raster, and a filter coupled to the memory for selectively combining at least a portion of the stored pixel values to provide pixel values of the image for a given line of a second raster, wherein positions of the pixels of the given line of the first raster are not linearly related to positions of the pixels of the given line of the second raster.

26. A processor comprising a memory for storing pixel values of an image from a given line of a first raster, and a filter coupled to the memory for selectively combining at least a portion of the stored pixel values to provide pixel values of the image for a given line of a second raster, wherein positions of the pixels of the given line of the first raster are not linearly related to positions of the pixels of the given line of the second raster, wherein said memory comprises a shift register for storing the pixel values from the given line of the first raster, and wherein said filter comprises a scaler coupled to said shift register for scaling at least a selected portion of the stored pixel values, and a combiner coupled to said scaler to provide the pixel values for the given line of the second raster.

27. A processor comprising:

a memory for storing pixel values of an image from a given line of a first raster, a filter coupled to the memory for selectively combining at least a portion of the stored pixel values to provide pixel values of the image for a given line of a second raster, wherein positions of the pixels of the given line of the first raster are not linearly related to positions of the pixels of the given line of the second raster, a second memory for storing the pixel values of the image from the given line of the second raster, and a second filter for selectively combining at least a portion of the pixel values stored in said second memory to provide modified pixel values of the image for the given line of the second raster.

28. The processor of claim 27 wherein said second memory comprises a second shift register for storing the pixel values from the given line of the second raster, and wherein said second filter comprises a second scaler coupled to said second shift register for scaling at least a selected portion of the pixel values stored in said second shift register, and a second combiner coupled to said second scaler to provide the modified pixel values for the given line of the second raster.

29. A cathode ray tube comprising:

a tube envelope having a faceplate and a screen electrode on the faceplate configured to be biased at a screen potential;

a source of plural beams of electrons directed toward said faceplate, wherein said source is configured for magnetic deflection of said plural beams of electrons;

a non-self-converging deflection yoke proximate said source of plural beams of electrons for magnetically deflecting the plural beams of electrons;

wherein said source of plural beams of electrons and said non-self converging deflection yoke are configured to substantially converge the plural beams of electrons when the deflected plural beams of electrons are at or near two opposing edges of said faceplate, rather than at or near the center of said faceplate;

a shadow mask proximate said faceplate having a plurality of apertures therethrough, wherein said shadow mask is configured to be biased at the screen potential, and phosphorescent material disposed on said faceplate for producing light in response to the beam of electrons impinging thereon, wherein said phosphorescent material includes a pattern of different phosphorescent materials on said faceplate that emit different color light in response to the deflected plural beams of electrons impinging thereon through the apertures of said shadow mask.

* * * * *